US005603535A

United States Patent [19]

Antonucci et al.

[11] Patent Number: 5,603,535

[45] Date of Patent: Feb. 18, 1997

[54] SLAM LATCH

[75] Inventors: Jeffrey L. Antonucci, King of Prussia, Pa.; Richard E. Schlack, Rising Sun, Md.; Paul Krape, Summerfield, N.C.

[73] Assignee: Southco, Inc., Concordville, Pa.

[21] Appl. No.: 517,410

[22] Filed: Aug. 21, 1995

Related U.S. Application Data

[63] Continuation-in-part of Ser. No. 978,900, Nov. 19, 1992, abandoned.

[51] Int. Cl.[6] ..... E05C 19/10

[52] U.S. Cl. ..... 292/128; 292/228; 292/DIG. 46

[58] Field of Search ..... 292/128, DIG. 46, 292/228, DIG. 53

[56] References Cited

U.S. PATENT DOCUMENTS

| | | | |
|---|---|---|---|
| 497,813 | 5/1893 | Pease | 292/128 |
| 2,523,727 | 9/1950 | Sevison | 292/128 |
| 3,797,870 | 3/1974 | Beckman | 292/228 X |
| 3,881,758 | 5/1975 | Gross | 292/128 X |

FOREIGN PATENT DOCUMENTS

| | | | |
|---|---|---|---|
| 1781476 | 9/1979 | Germany | 292/128 |
| 4346 | 12/1891 | Switzerland | 292/128 |

*Primary Examiner*—Rodney M. Lindsey
*Attorney, Agent, or Firm*—Paul & Paul

[57] ABSTRACT

A slam latch for securing a slidable window or door to a corresponding frame consists of a housing including a base plate, a catch and a keeper wherein the catch is spring biased downward against the housing so as to become operatively engaged with the keeper attached to the frame when the door or window is moved to a closed position causing the catch and keeper to become in juxtaposition to one another.

27 Claims, 5 Drawing Sheets

SLAM LATCH

CROSS-REFERENCE TO RELATED APPLICATIONS

This application is a continuation-in-part of U.S. application Ser. No. 07,978,900 filed Nov. 19, 1992 now abandoned.

BACKGROUND OF THE INVENTION

Latches for windows, doors and the like are well known and are generally comprised of a catch fixed to the door or window and movably engageable with the panel or frame of the portal in question. The catch is engageable with a keeper that is attached to the other panel/frame of the portal depending on the arrangement and will so engage when the portal is in the closed position. Metal latches on window frames are perhaps the most familiar latches whereby the catch pivots or swings about a post in a base secured to one of the window frames. The catch slides under and engages the keeper which is generally comprised of a metal flange secured to the other frame when the catch and keeper are in juxtaposition to one another. As such, the window is closed and locked. Turning the catch in the opposite direction unlocks the window and allows its opening.

Latches may also be comprised of a catch that is biased by a spring or other means that actuates the catch in a generally lock-wise direction with respect to the keeper. This allows for the automatic engagement of catch and keeper when the window or door is forcefully closed. There is no need for manual manipulation of the catch into the flange of the keeper.

The present invention is a novel latch whose catch is biased in this manner so that when applied to sliding doors or windows, the catch automatically engages the keeper when the door/window is slideably closed. The present invention also comprises a latch that is easily opened through the application of manual pressure at a point on the catch that pivotally forces it in a direction opposite to that of this bias thereby disengaging it from its locked position with the keeper so as to allow the door/frame to be slideably opened.

U.S. Pat. No. 3,918,754 to Isbister shows a plastics fastener for use in an automobile glove box whereby the latch unit is formed as a one-piece resiliently flexible plastics material comprising two body portions that are hinged to one another and which are further hinged to a latch and button respectively. Manual actuation of the button moves the catch from an operative, keeper engaging position to an inoperative, keeper-disengaged position. This enables the glove box to open accordingly.

U.S. Pat. No. 3,841,674 to Bisbing discloses a sliding-action slam latch for securing a door panel in closed position. The slam latch is of one-piece construction and is installed in a single opening in the door panel and is self retained therein. The latch operates by a spring biased sliding action to engage the door frame or striker plate. In one embodiment of the invention, the spring bias is provided by the resilience inherent in the plastic material from which the latch is made.

Finally, U.S. Pat. No. 5,158,329 to Schlack also discloses a slam latch for a sliding or hinged cabinet door that is comprised of side and rear walls from which extends a flexible lower plate having a catch. The latch mounts in an aperture positioned so that the flexible lower plate extends beyond the edge of the door and over the edge of an adjacent panel to secure the two together.

The slam action principle disclosed in the above reference is well known in the art and is embodied in a number of designs which usually incorporate a housing that encloses several components, one of which is a sliding bolt or pivoting spring biased catch. The general characteristic of these slam latches is the actuation of the latch to secure the door or window by cooperation with a door-framed-mounted striker plate when the door or window is pushed or slammed shut. In order to open the door/window secured with such a latch, a finger or pawl is provided for the manual exertion of force against the spring bias which disengages the catch from the striker plate.

The present invention is a novel slam latch for use in sliding glass doors that is of simplistic design and manufacture. The novel slam latch of the present invention is easy to operate and in one embodiment has eliminated the need of a pinned, biased connection between the catch and housing. Simple exertion of lateral pressure against the resilient portion of the latch is then translated into outward movement of the catch element itself, thereby disengaging it from the keeper unit. The slam latches of the present invention are particularly useful in sliding windows of automobiles and vans.

SUMMARY DESCRIPTION OF THE DRAWINGS

The present invention is a simple, easy to use slam latch for use on sliding doors or windows. In one embodiment a plate serves as the attachment base for the latch to the door/window and also serves as the pivot and retainer for the catch, thereby eliminating the need for a pinned connection between the catch and housing. The construction and design of the slam latch also transfers any force applied against the door or glass (such as attempts at forced entry) directly from the attachment plate to the catch, rather than from the plate through the housing to the catch. The slam latch also includes a spring mechanism that is integral with the catch so as to bias it in a keeper-engaging direction and therefore does not require a separate spring for this purpose.

DETAILED DESCRIPTION OF THE INVENTION

Figure 1:
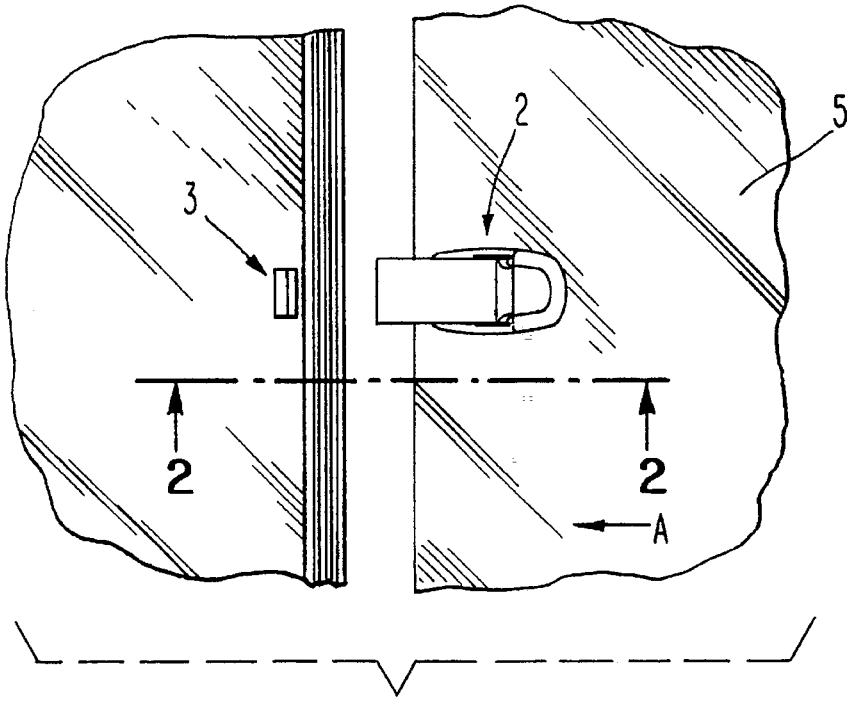
FIG. 1 is a top view of the entire slam latch assembly in operative relationship with an open door/window.

Referring now to FIG. 1, the entire slam latch assembly of the present invention is shown in operative relationship with a sliding door or window to which it is attached. The catch assembly (2) is secured to the glass of the door or window using any suitable adhesive and is aligned with the keeper element (3) which is attached to the surrounding frame. The components may be made out of metal or plastic although plastic is the preferred embodiment. Movement of the door/window as denoted by arrow A which closes same brings the catch assembly (2) into close proximity with the keeper (3) until they become operatively joined in a locked or secured position as will be examined more fully below.

Figure 2:
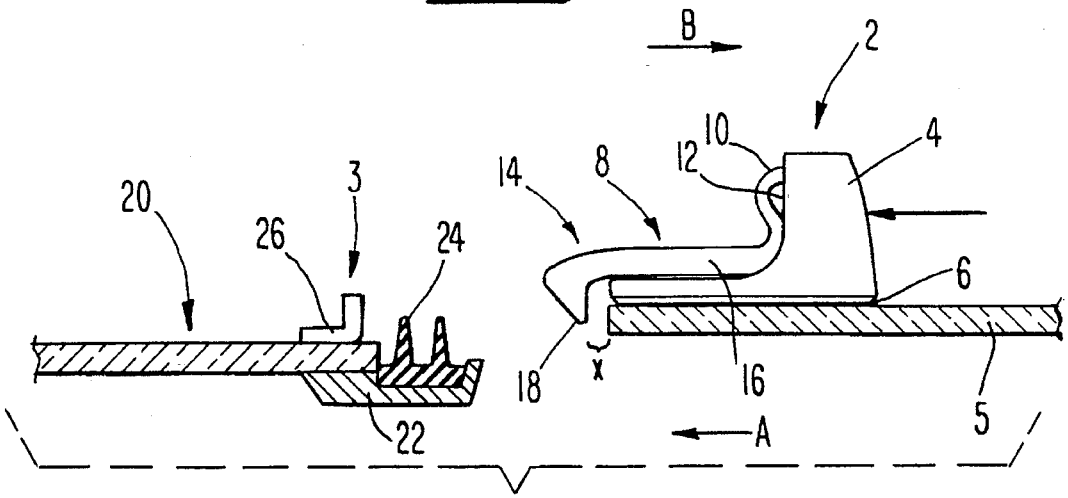
FIG. 2 is a lateral side view of the same assembly taken from a perspective of lines 2—2 in FIG. 1.

Referring now to FIG. 2, the catch assembly (2) of the present invention is shown from a side view as it appears attached to a sliding glass window or door (5). The catch assembly (2) consists of a housing (4) which is attached by a base plate (6) directly to the glass or panel surface and the catch (8) itself which is one piece construction comprised of essentially four operative components. A spring biasing means (not shown) operates within the housing as will be more fully described below, A button section (10), integral and operatively associated with said spring means, protrudes from the housing aperture (12) and is actuated by the application of force in the direction of arrow B.

Figure 3:
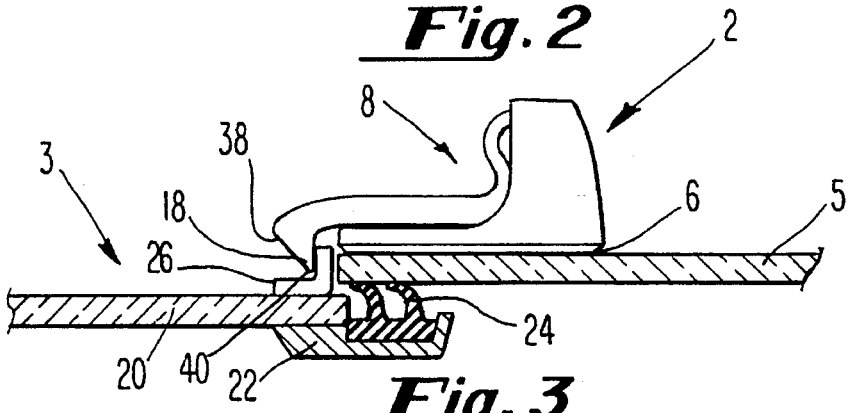
FIG. 3 is a lateral side view of the same assembly set forth in FIG. 2 with the door/window in a closed and locked position.

The catch (8) extends from the button (10) by a tongue section (16) and ends in a pointed lip (18) that actually engages the keeper (3) and secures the door/window in a locked position. The lip (18) hangs down from the tongue section (16) and is separated from the base of the housing (6) a sufficient distance (x) to enable engagement with the keeper element, The fixed keeper position (3) of the slam latch of the present invention is also shown in FIG. 2. The keeper assembly (3) consists of the glass window or door panel (20) the frame (22), a U-shaped rubber gasket (24) and the L-shaped keeper (26). As will be described in greater detail and briefly described in FIG. 1, movement of the sliding door or window for purposes of closing it (arrow A) forces the tapered lip (18) over the U-shaped rubber gasket (24) and into a mechanically coupled engagement with the keeper assembly (3) securing and locking the window/door (5) to the frame (22) as shown in FIG. 3.

Figure 4:
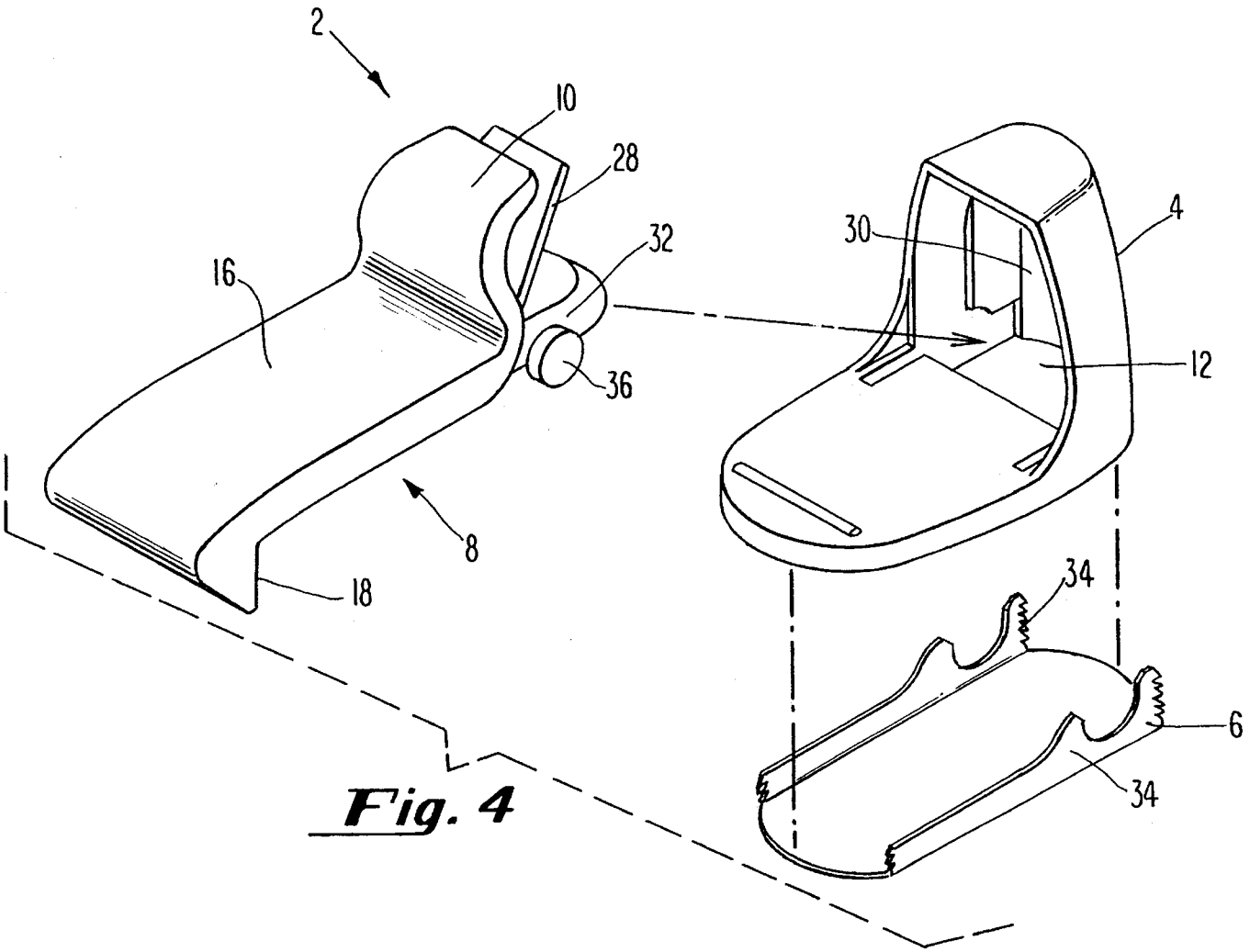
FIG. 4 is an exploded schematic of the catch assembly showing its three operative parts—catch, base and housing.

FIG. 4 shows the catch assembly (2) in an exploded perspective comprising the three unit elements, namely the housing (4), the catch (8) and the base plate (6). As shown by the arrows, the catch (8) fits into the aperture of the housing (12) so that the spring means (28) abuts with and is flush against the inside of the rear wall (30) of the housing (4). Integral with the spring means (28) is a pivot (32) which movably engages a U-shaped journal (34) of the base plate (6) by a pin or roller member (36). Assembled, the abutment of the spring means (28) against the inside of rear wall (30) provides a point of tension against which the spring means (28) can bias about the pivot (32) and journal (34).

Figure 5:
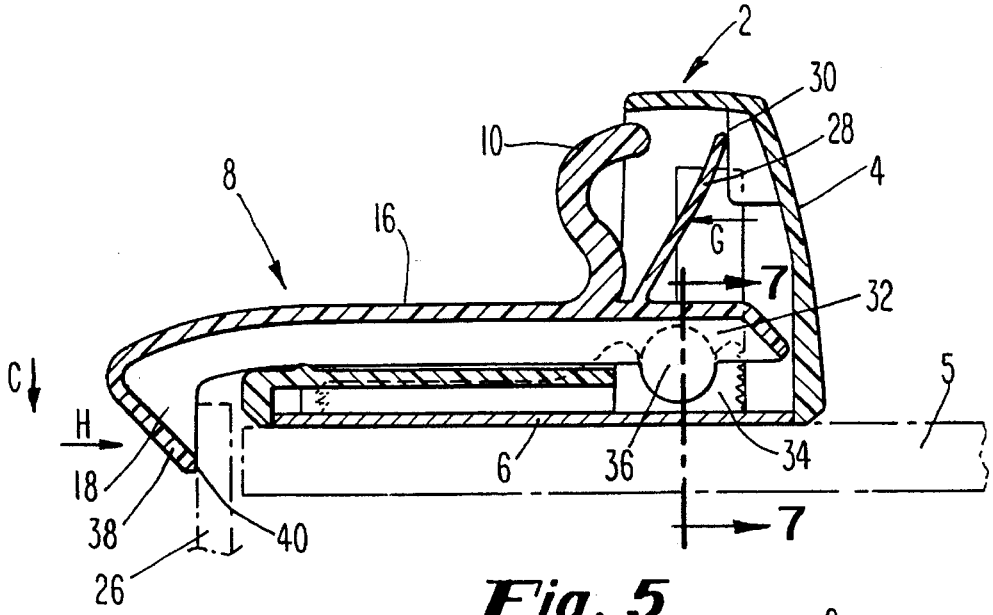
FIG. 5 is an exposed cross-sectional side view of the catch assembly of the present invention in closed and locked position.

FIG. 5 shows a cross-sectional lateral view of the catch assembly (2) with the elements of FIG. 4 in assembled relationship to one another. The catch (8) is contained within housing (4) which is attached to the door or window (5) by the base plate (6). The catch (8) is secured to the housing assembly (4) by the pivot (32) which is movably connected or inserted into the U-shaped journal (34).

When the catch assembly (2) and keeper unit (3) are in juxtaposition and operatively joined to one another such that the door or window is closed as shown in FIG. 5, the spring means (28) which comprises a flange or lever is in abutment with the rear wall of the housing (4). This point of contact provides the spring with a reference to which it can bias the tongue (16) and lip (18) downward towards the plane created by the surface of the window or door. (arrow C). The force exerted by the bias of the spring means (28) retains the catch (8) in the secured or locked position when the catch assembly (2) and keeper assembly (3) are in close proximity and engaging relationship with one another whereby the door or window is closed. The same bias maintains the catch (8) parallel with the surface of the window/door (5) when the catch and keeper assemblies are not so engaged. This allows for the slam-latch function of the device as will be hereinafter described.

Figure 6:
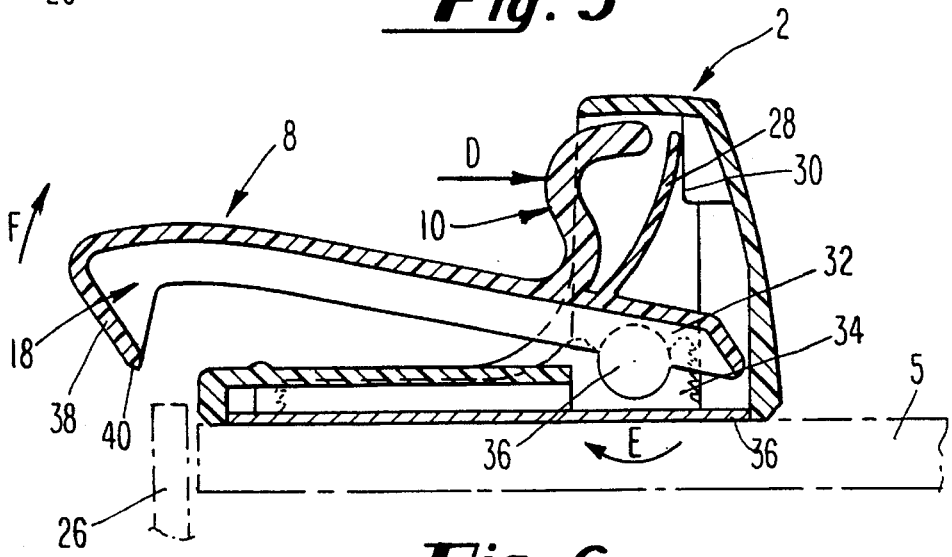
FIG. 6 is an exposed cross-sectional side view of the catch assembly when force is exerted to open it.

FIG. 6 is a cross-sectional lateral view of the present invention as shown in FIG. 5 with force (arrow D) being applied to the button (10) so that the catch assembly (2) is releasably opened from the keeper assembly (3) allowing for the opening of the window or door in question. As can be seen from the drawing, force applied against the button using ones thumb or fore-finger results in a pivoting action of the catch (8) about the U-shaped journal (34) in a clockwise direction (arrow E) afforded by the operative connection of the pin (36) portion of the pivot (32) to the journal (34) in the base (6). Manual pressure against the button (10) must be strong enough to over-come the bias of the spring forcing the catch (8) downward (arrow C, FIG. 5). Application of this force (arrow B, FIG. 2) pivots the catch (8) in a clockwise direction (arrow E) and results in the upward movement of the catch (8) (arrow F) thereby disengaging it from the keeper element (26).

Assembled then, as seen in FIG. 5, the pointed lip (18) is urged downward as indicated by arrow C by the biased force exerted laterally by the spring means (28) as it pushes against the inner wall of rear wall (30) as indicated by arrow G. This is brought about by the translation of lateral force (G) into vertical force (c) occurring at the point where the pivot (32) and journal (34) are rotatively coupled.

Referring now to FIG. 6, the lateral force exerted against the button (10) (shown by arrow D) will be resisted by the bias of the spring means (28) but, as opposed to the bias, will translate into an opposite, upward vertical movement of the lip (18) (arrow F) which, operationally, disengages the catch (8) from the keeper element (26) and allows for window/door movement. The same upward movement (arrow F) of the catch (8) will occur when the window/door is closed as lateral force (arrow H, FIG. 5) is exerted against the tapered, pointed lip (18) as the keeper element (26) is forced against the lip (18) and moves along the slanted or curved frontal edge (38) of lip (18). In operation, this occurs during the sliding of the door/window to a closed position whereby the lip (18) initially engages the keeper which operationally engages and moves along the lip's edge (38) until it comes to the tip (40) at which time the compacted spring means (28) which is now compressed forces the lip (22) down into locking engagement with the keeper element (26).

Figure 7:
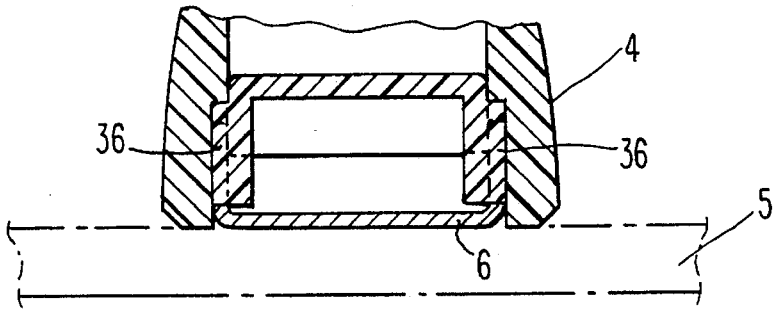
FIG. 7 is a partial cross-sectional view taken along lines 7—7 of FIG. 5.

FIG. 7 is a cross-sectional lateral view of the catch assembly (2) taken along lines 7—7 of FIG. 5 showing the geometric and functional relationship of the housing (4), the base plate (6) and the pivot (32) of the catch (8). This arrangement enables lateral forces exerted by the bias of the spring to be translated into longitudinal, downward forces of the catch (8) so as to enable engagement with the keeper assembly (3) in order to secure the door or window in the closed position. This arrangement also enables the application of manual force, opposite to that of the spring bias, against the button which is then translated in longitudinal, upward movement of the catch resulting in the disengagement of the catch from the keeper.

Returning to FIG. 3, this operative relationship of the catch assembly (2) and keeper assembly (3) can be seen when the door/window is in the closed and secured position. As the window or door is slideably closed, the pointed tip (18) abuts the U-shaped rubber gasket (24) which, due to its resilient character, bends and gives way to the biased force of the spring means (28). The L-shaped keeper (26) however, is firmly attached to the glass/panel (20) and frame (22) and is an immovable ledge over which the catch (8) must move. The force exerted on the catch (8) against the keeper (26) once contact is made moves the tapered lip and tongue in an upward direction (FIG. 6, arrow F) as the tension against the bias in the spring means (28) is increased. The point of abutment between keeper (26) and lip (18) moves along the edge of the lip (38) which may be curved or slanted until it reaches and passes the tip (40) of the lip (18) of the catch at which time the tension that has built up in the spring means forces the lip (18) downward into locking engagement with the keeper (26) as shown in FIG. 3. The U-shaped rubber gasket (24), extending beyond the plane as defined by the sliding door or window (5) is again resilient in character, and bends in favor thereof as engagement takes place, thereby forming a seal at the junction between the sliding window/door and the main frame glass or panel.

Figure 8:
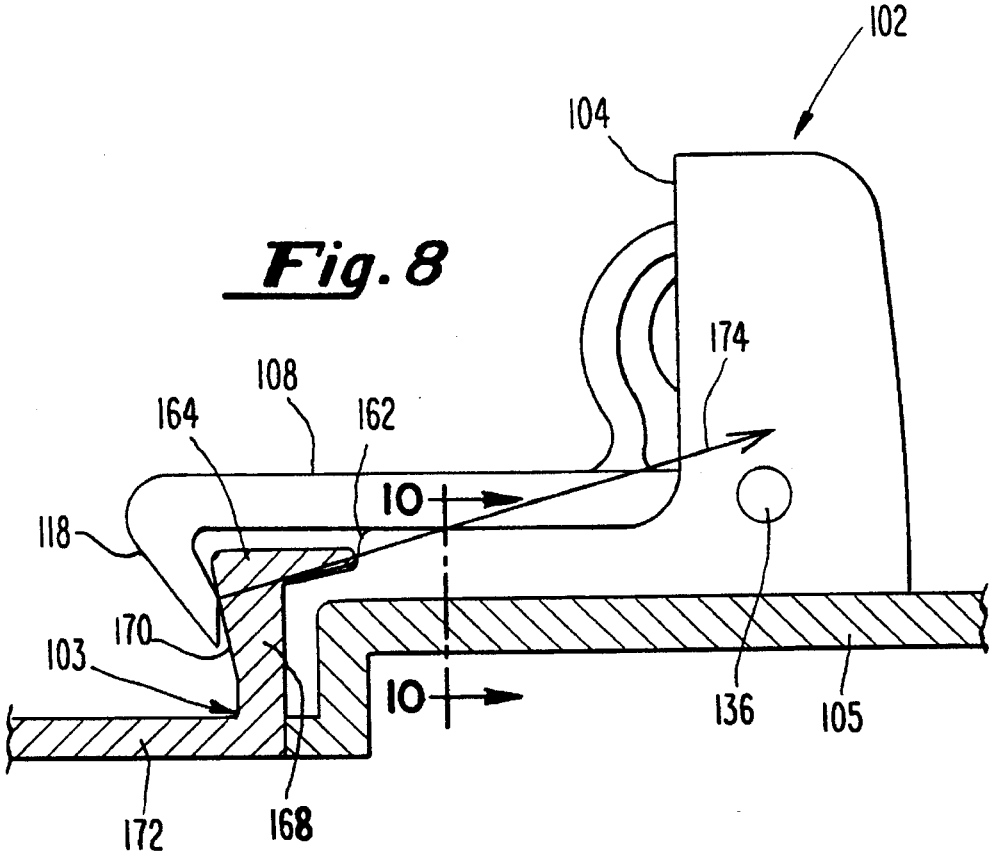
FIG. 8 is a side elevational view of a first alternate embodiment of the slam latch assembly of the present invention, the slam latch assembly shown in a latched position.
Figure 10:
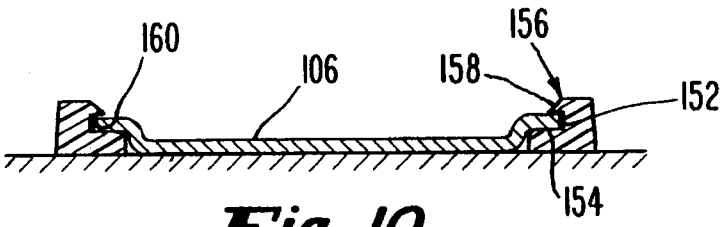
FIG. 10 is a sectional elevational view taken along the line 10—10 in FIG. 8.
Figure 9:
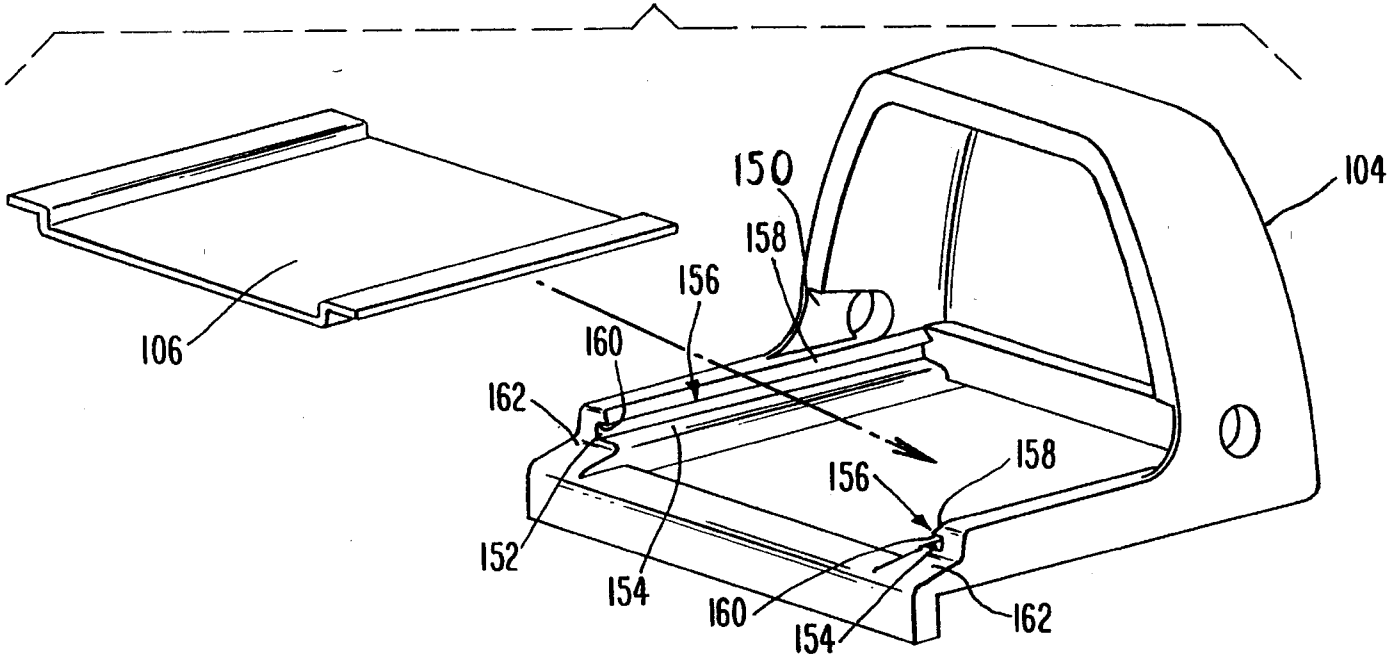
FIG. 9 is an exploded perspective view illustrating a base and a housing of FIG. 8.

In FIGS. 8–11 are illustrated two alternate embodiments of the slam latch assembly of the present invention. In the two alternate embodiments, the portions which correspond to the portions of the slam latch assembly earlier described, will be described using the same number designations except beginning with the number 100 in relation to the first alternate embodiment and 200 in relation to the second alternate embodiment. Accordingly, the slam latch assembly illustrated in FIGS. 8–10 includes a catch assembly (102) which comprises as its portions a housing (104), a catch (108) and a base plate (106). As illustrated in FIG. 9, similar to the housing (4), the housing (104) is also comprised of a generally elongated bottom wall, opposing side walls and a rear wall each connected to the bottom wall and a top wall connected to each of the side walls and rear wall. In this manner, the housing (4) and (104) define a cavity adapted to envelope and conceal the spring member (28) and (128). As best illustrated in FIGS. 8 and 9, one difference in the housing (104) is that the side walls include substantially cylindrical aligned apertures in order for receiving the pin or roller member (136) for connection with the catch (108). In addition, as is shown in FIG. 9, the inner wall surfaces of the side walls are also preferably provided with generally rectangular channels (150), which extend from the front surfaces of the side walls to the apertures in order to facilitate the mounting of the pin (136). Further, as best seen in FIGS. 9 and 10, the bottom wall of the housing (104) also includes a generally rectangular-shaped opening formed therethrough in order for receiving the base plate (106). In this embodiment, preferably a pair of substantially elongated channels (152) are provided within opposing sides of the bottom wall proximate its perimeter surface. The channels (152) which extend substantially the entire longitudinal axis of the bottom wall are defined by L-shaped seats (154) and containing members (156) at spaced separation. The containing members (156) are defined by an inclined camming surface (158) and a locking surface (160), which operate to retain the base plate (106) after it has been assembled within the housing (104) in the manner described below. similar to the base plate (6), the base plate (106) also is defined by a generally elongated connected wall which includes attached to its upper surface a pair of opposing side walls. However, as best illustrated in FIG. 9, the side walls of the base plate (106) are generally L-shaped which correspond to the L-shaped seats (154) within the bottom wall of the housing (104). Upon assembly of the base plate (106), rather than being inserted from the bottom of the housing as illustrated with regard to the base plate (6), the base plate (106) is inserted from the top of the housing (104) and into the substantially rectangular shaped opening in the bottom wall. As this occurs, the L-shaped sidewalls of the base plate (106) initially engage the camming surfaces (158) of the containing members (156). As the base plate (106) is mounted within the housing (104), the L-shaped side walls are moved past the inclined camming surfaces (158) and then are snapped into the position within the channels (152), with the locking surfaces (160) working to retain the base plate (106) in the mounted position. Although not shown, a variation in this design is to reverse the positions of the containing members (156) and L-shaped seats (154) so that the base plate (106) would be installed from the bottom of the housing (104), similar to that in relation to the catch assembly (2) earlier described.

Further, as best illustrated in FIG. 8, at least one and preferably two opposing cavities (162) are provided within the bottom wall of the housing (104) proximate its front end. In the present embodiment, the cavities (162) define substantially ramped surfaces extending upward from the first end of the bottom wall and terminate by substantially vertical walls. The purpose of the cavities (162) is to positively locate the catch assembly (102) relative to the keeper. In this embodiment, the keeper (103) includes a top wall (164) which is substantially parallel to the frame and extends in a direction of the window/door (105). As best illustrated in FIGS. 8 and 9, preferably the configuration of the top wall (164) of the keeper (103) corresponds to that of the cavities (162) provided within the housing (104). In this embodiment, the top wall (164) is provided within a substantially ramped bottom surface which tapers inwardly towards the window/door (105) and which is received within the cavities (162) as the members are being latched together.

Furthermore, as best illustrated in FIG. 8, the keeper (103) further includes an upper wall (168) which is connected with the top wall (164) and includes an angled retaining surface (170) which tampers inwardly from the top wall (164) in the direction of the bottom wall (172). The advantage provided by this particular configuration of the keeper (103) is that upon engagement by the catch (108), the line of force from the point of contact between the tip (118) and the retaining surface (170) will pass above the pivot point (136) of the catch assembly (102) as is indicated by the arrow (174); the effect of which operates as a security feature tending to close the latch when an opening force is applied to the window/door (105) in the direction of its travel.

In this embodiments preferably the housing (104) and catch (108) are of plastics respectively, and the base plate (106) is of aluminum. However, it should be understood that these components can be manufactured of other suitable materials without departing from the spirit of the present invention. Furthers the pin (136) which in the present embodiment is provided as a part of the catch (108), can also be provided as a separate member which is connected through an aperture within the catch (108) and comprised of any suitable materials such as stainless steel.

Figure 11:
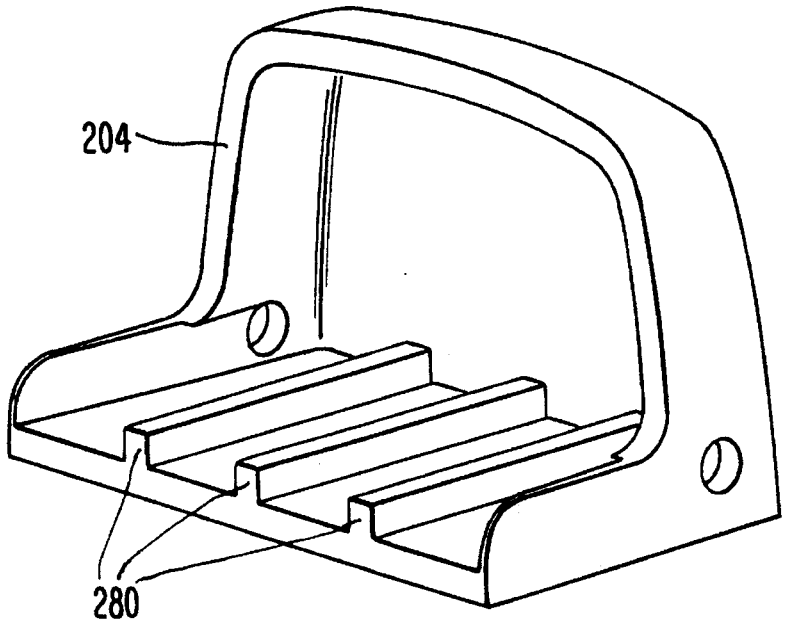
FIG. 11 is a perspective view illustrating a housing of a second alternate embodiment of the present invention.

In FIG. 11 is illustrated a perspective view of a housing (204) according to a third alternate embodiment of the slam latch of the present invention. The primary difference in the slam latch of the present embodiment from that earlier described is that there is no separate base plate but rather the base plate is now provided as a part of the housing (204), which operates to reduce the number of parts in the device. In this embodiment, preferably the one-piece housing (204) is comprised of nylon, similar to the housing (104), however, other suitable materials can also be used. As illustrated in FIG. 11, the bottom wall of the housing (204) is included with a substantially planar lower surface which is adapted to be bonded directly to the glass of the door/window. Although not shown, the remaining portions of the slam latch of the present embodiment are the same as that earlier described in relation to the first alternate embodiment of the present invention. Further, in this embodiment, the upper surface of the bottom wall is also included with three aligned ribs (280) extending along its longitudinal axis onto which the catch is adapted to seat against, however, it should be understood that this is not required. Specifically, the upper surface of the bottom wall can also be provided of different configurations, such as being substantially flat similar to that of the lower surface.

It is recognized that minor alterations and changes can be made with respect to the slam latch as herein described and disclosed. These changes may not be reflected in the specific embodiment as set forth herein but they are still considered within the spirit and scope of the present invention as set forth in the following claims.

For instance, it should be understood that the features disclosed in relation to any one of the embodiments of the present invention can also have application in the remaining embodiments as well. For example, the position locating feature in relation to the keeper and housing disclosed in the first alternate embodiment of the present invention can also be adapted for use with the other embodiments where desired. Similarly, the same would apply with respect to the angled keeper disclosed in relation to the second embodiment which operates as a security feature. In addition, although the catch is illustrated in the first alternate embodiment as including a substantially ramped lip, it should be understood that the lip can also be substantially planar, similar to that described in relation to the catch assembly (2).

Furthermore, it should be understood that each of the particular features disclosed in relation to any one embodiment of the present invention all do not need to be present in that embodiment in order to be considered within the scope and spirit of the present invention. For example, in the first alternate embodiment of the present invention, neither the position locating feature nor angled keeper feature need to be present.

What we claim is:

1. A slam latch adapted for being mounted on a glass panel of a slidable glass window or door for latching with a keeper on a corresponding frame, the slam latch comprising:

a base plate;

a housing connected with said base plate;

a one-piece catch disposed within said housing adapted for latching with said keeper;

wherein said housing includes a generally elongated bottom wall substantially parallel with a longitudinal axis of the base plate, said catch defining first and second ends along a longitudinal axis and includes a tongue generally elongated along said longitudinal axis, said tongue including a lower tongue surface substantially parallel to and seated against said bottom wall of said housing in a closed position of said latch, said tongue further including a lip proximate the second end of said catch for latching with said keeper.

2. A latch according to claim 1, wherein said housing further includes a rear wall extending upward from said bottom wall and said catch further includes a spring member having a first end connected to and extending from a top surface of said catch and a second end engaging an inner surface of said rear wall of said housing, wherein the engagement of the spring member with the rear wall of the housing creates a tension upon the spring member in a direction generally away from of the rear wall of the housing for rotating the catch into the closed position.

3. A slam latch according to claim 2, further including a pivot connected to said catch between said first end of said spring member and the first end of said catch.

4. A slam latch according to claim 3, wherein said catch further includes a button connected to and extending from said top surface of said catch between said lip and said first end of said spring member, said button being adapted to rotate said catch about said pivot for raising said lip from said closed position to an open position, wherein said button includes an outer surface and said button is actuated through application of force upon the outer surface of the button in a direction generally along the longitudinal axis of the catch, wherein upon actuation of said button, said button is rotated in a direction of the rear wall of the housing in opposition to the tension produced by the spring member.

5. A slam latch according to claim 4, wherein the housing further includes a pair of opposing side walls at spaced separation connected with said rear wall and extended upward from said bottom wall, said housing including a top wall at spaced separation from and opposing said bottom wall and connected with said rear and side walls, wherein said bottom, rear, side and top walls define a cavity enveloping said spring member and receiving said button as the button is rotated upon its actuation.

6. A latch according to claim 5, wherein said base plate and said housing are of a one-piece construction, with said base plate being provided as a part of said bottom wall of said housing.

7. A slam latch according to claim 5, wherein said base plate comprises a separate member, and said bottom wall of said housing includes an aperture therein for receiving said base plate.

8. A slam latch according to any one of claims 6-7, wherein said base plate is adapted to be secured to said glass by an adhesive.

9. A slam latch according to any one of claims 6-7, wherein said keeper defines a bottom wall adapted for being secured to said frame and an upper wall for engaging said lip of said catch, wherein said upper wall of said keeper defines a retaining surface engaging said lip of said catch when in a latched position, wherein said retaining surface of said upper wall includes a taper extending inward from said upper wall in a direction of said bottom wall.

10. A slam latch according to claim 7, wherein said base plate includes a generally elongated connecting wall having upper and lower surfaces and at least one pair of opposing side walls at spaced separation extending from said upper surface of said connecting wall in a direction of said bottom wall of said housing, wherein said housing includes proximate a perimeter of said bottom wall a pair of substantially elongated channels extending in a direction of the longitudinal axis of the bottom wall for receiving said side walls of said base plate.

11. A slam latch according to claim 10, wherein said substantially elongated channels of said bottom wall and said base plate further include means for retaining said base plate within said bottom wall.

12. A slam latch according to claim 11, wherein said side walls of said base plate are generally L-shaped and said channels within said bottom wall define correspondingly L-shaped seats extending substantially the length of said bottom wall.

13. A slam latch according to claim 12, wherein said channels within said bottom wall further include a containing member extending substantially parallel and at spaced separation from said L-shaped seats, said containing member including a camming surface and a locking surface thereon, wherein said base plate upon assembly is received within said housing and said L-shaped side walls of said base plate are brought into engagement with said camming surface, wherein as said base plate is moved into said L-shaped seats, said L-shaped side walls of the base plate are moved past said camming surface, with said locking surface of said containing member being positioned proximate said L-shaped side walls when the base plate is assembled.

14. A slam latch according to claim 40, wherein said side walls of said base plate are generally elongated and of a defined width, wherein said channels of said bottom wall define a pair of opposing surfaces at spaced separation, with said side walls of said base plate being pressed fit between said spaced surfaces of said bottom wall.

15. A slam latch according to any one of claims 6-7 wherein said keeper defines a bottom wall adapted for being secured to said frame and an upper wall for engaging said lip of said catch, said keeper and said housing further including means for positively locating the latch with said keeper.

16. A slam latch according to claim 15, wherein said keeper further includes a top wall substantially parallel to said bottom wall and extending in a direction of said slidable window or door, said housing further including at least one cavity within said bottom wall and proximate a first end thereof distal said rear wall, wherein said cavity corresponds in configuration with and is adapted to receive said top wall of said keeper when in a latched position as said locating means.

17. A slam latch comprising:

a base plate adapted for securing the slam latch to a first member;

a housing connected with said base plate, the housing including a generally elongated bottom wall substantially parallel with a longitudinal axis of the base plate, a rear wall and a pair of opposing side walls at spaced separation connected with said rear wall and each extending upward from said bottom wall, said housing further including a top wall at spaced separation from and opposing said bottom wall and connected with said rear and side walls, wherein said bottom, rear, side and top walls define a cavity;

a one-piece catch defining first and second ends along a longitudinal axis adapted for latching a keeper on a second member when in a closed position, the catch including:

a tongue generally elongated along said longitudinal axis of said catch and including a lower tongue surface substantially parallel to and seated against said bottom wall of said housing when in said closed position, said tongue including a lip proximate the second end of said catch;

a spring member having a first end connected to and extending from a top surface of said catch and a second end engaging an inner surface of said rear wall of said housing, wherein the engagement of the spring member with the rear wall of the housing creates a tension upon the spring member in a direction generally away from of the rear wall of the housing which rotates the catch into said closed position;

a pivot connected to said catch between said first end of said catch and said spring member; and a button connected to and extending from said top surface of said catch between said lip and said spring member, said button being adapted to rotate said catch about said pivot for raising said lip from said closed position to an open position, wherein said button includes an outer surface and said button is actuated through application of force upon the outer surface of the button in the direction generally along the longitudinal axis of the catch, wherein upon actuation of said button, said button is rotated in a direction of the rear wall of the housing in opposition to the tension provided by the spring member;

wherein said spring member is enveloped and concealed by said cavity provided within the housing and said button is received within said cavity when the button is rotated upon actuation.

18. A slam latch according to claim 17, wherein said base plate and housing are of one-piece construction, with said base plate being provided as a part of said bottom wall of the housing.

19. A slam latch according to claim 17, wherein said base plate comprises a separate member, and said bottom wall of said housing includes an aperture therein for receiving said base plate.

20. A slam latch according to claim 19, wherein said base plate includes a generally elongated connecting wall having upper and lower surfaces and at least one pair of opposing side walls at spaced separation extending from said upper surface of said connecting wall in a direction of said bottom wall of said housing, wherein said housing includes proximate a perimeter of said bottom wall a pair of substantially elongated channels extending the longitudinal axis of said bottom wall for receiving said side walls of said base plate.

21. A slam latch according to claim 20, wherein said substantially elongated channels of said bottom wall and said base plate further include means for retaining said base plate within said bottom wall.

22. A slam latch according to claim 21, wherein said side walls of said base plate are generally L-shaped and said channels within said bottom wall define corresponding L-shaped seats extending substantially the length of said bottom wall.

23. A slam latch according to claim 22, wherein said housing includes a containing member extending substantially parallel and at spaced separation from said L-shaped seats, said containing member including a camming surface and a locking surface thereon, wherein said base plate upon assembly is received within said housing and said L-shaped side walls of said base plate are brought into engagement with said camming surface, wherein as said base plate is moved into said L-shaped seats, said L-shaped side walls of said base plate are moved past said camming surface, with said locking surface of said containing member being positioned proximate said L-shaped side walls when the base plate is assembled.

24. A slam latch according to claim 21, wherein said side walls of said base plate are generally elongated and of defined width, wherein said channels of said bottom wall define a pair of opposing surfaces at spaced separation, with said side walls of said base plate being pressed fit between said spaced surfaces of said housing.

25. A slam latch according to claim 17 wherein said keeper defines a bottom wall adapted for being secured to said second member and an upper wall for engaging said lip of said catch.

26. A slam latch according to claim 25, wherein said keeper and said housing include means for positively locating the latch with said keeper, wherein said keeper includes a top wall substantially parallel to said second member and extending in a direction of said catch, said housing further including at least one cavity within said bottom wall and proximate a first end thereof distal said rear wall, wherein said cavity corresponds in configuration with and is adapted to receive said top wall of said keeper as said locating means.

27. A slam latch according to claim 25 wherein said upper wall of said keeper defines a retaining surface in engagement with said lip of said catch when in the latched position, wherein said retaining surface includes a taper extending inward proximate a top surface of said upper wall in a direction of said bottom wall.

* * * * *

UNITED STATES PATENT AND TRADEMARK OFFICE

CERTIFICATE OF CORRECTION

PATENT NO. : 5,603,535

DATED : February 18, 1997

INVENTOR(S) : Jeffrey L. Antonucci

It is certified that error appears in the above-indentified patent and that said Letters Patent is hereby corrected as shown below:

Col. 3, line 31, between the words "below" and "A", the coma should be deleted and replaced with --.--.

Col. 3, line 41, at the end of the sentence, the coma should be deleted and replaced with --.--.

Col. 5, line 32, between "again" and "resilient", please insert --,--.

Col. 6, line 63, "plastics" should be deleted and replaced with --plastic,--.

Col. 6, line 67, "Furthers" should be deleted and replaced with --Further,--.

Col. 8, in claim 1, line 6, "latch" should be deleted and replaced with --catch--.

Col. 9, in claim 14, line 26, "40" should be deleted and replaced with --10--.

Signed and Sealed this

Twentieth Day of May, 1997

Bruce Lehman

*Attest:*

BRUCE LEHMAN

*Attesting Officer*

*Commissioner of Patents and Trademarks*